US006428372B1

(12) United States Patent
Belt

(10) Patent No.: US 6,428,372 B1
(45) Date of Patent: Aug. 6, 2002

(54) WATER JET PROPULSION UNIT WITH RETRACTABLE RUDDER

(75) Inventor: Fletcher C. Belt, Woodstock, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/928,063

(22) Filed: Aug. 11, 2001

(51) Int. Cl.[7] ..... B63H 11/117
(52) U.S. Cl. ..... 440/43; 114/162
(58) Field of Search ..... 440/40, 41, 42, 440/43; 114/162

(56) References Cited

U.S. PATENT DOCUMENTS

| | | | | |
|---|---|---|---|---|
| 3,906,885 A | | 9/1975 | Woodfill | 115/12 |
| 3,976,026 A | | 8/1976 | Eastling | 115/12 |
| 3,982,494 A | | 9/1976 | Posti | 115/12 |
| 4,391,593 A | | 7/1983 | Whitworth | 440/70 |
| 4,779,553 A | * | 10/1988 | Wildhaber, Sr. | 114/128 |
| 4,949,662 A | | 8/1990 | Kobayashi | 114/162 |
| 5,094,182 A | | 3/1992 | Simner | 114/163 |
| 5,113,777 A | | 5/1992 | Kobayashi | 114/144 |
| 5,167,547 A | | 12/1992 | Kobayashi et al. | 440/42 |
| 5,421,753 A | | 6/1995 | Roos | 440/43 |
| 6,086,437 A | * | 7/2000 | Murray | 114/162 |

* cited by examiner

*Primary Examiner*—Jesus D. Sotelo
(74) *Attorney, Agent, or Firm*—Ostrager Chong & Flaherty LLP

(57) ABSTRACT

A jet-powered watercraft has a water jet propulsion unit driven by a powerhead and a rudder pivotably mounted to the water jet propulsion unit. The rudder is pivotable between a retracted position, where the rudder extends out of the water, and a down position, where the rudder extends in the water. Means are provided for changing the position of the rudder when the revolutions per unit time of the powerhead reaches a predetermined threshold, e.g., pivoting the rudder from the down position to the retracted position when the powerhead rpm level exceeds a predetermined threshold. In one embodiment, the revolutions per unit time of the drive shaft are detected. In another embodiment, the control position of the operator throttle control device is detected. Pivoting of the rudder may be actuated by a solenoid, a hydraulic cylinder or any other functionally equivalent electrical, mechanical or electromechanical device. When the water jet propulsion unit is operated with less than a minimum controllable steering thrust, the watercraft can be steered using the rudder in the down position.

26 Claims, 4 Drawing Sheets

WATER JET PROPULSION UNIT WITH RETRACTABLE RUDDER

FIELD OF THE INVENTION

This invention generally relates to mechanisms for steering boats and other watercraft. In particular, the invention relates to mechanisms for steering jet-powered watercraft.

BACKGROUND OF THE INVENTION

It is known to propel a boat or other watercraft using a water jet apparatus, with the powerhead placed inside (inboard) or outside (outboard) the hull and an axial-flow water jet apparatus mounted outside the hull below the waterline. The drive shaft of the water jet apparatus is coupled to the crankshaft of the motor. The water jet apparatus comprises an impeller mounted on the drive shaft and a housing surrounding the impeller. The interior surface of the housing defines a water tunnel. The impeller is designed such that during motor operation, the rotating impeller impels water rearward through the water tunnel and out an exit nozzle. The reaction force of the rearward water flow exiting the jet propulsion device propels the watercraft forward.

To facilitate use of jet-propelled boats in shallow water, it is known to mount the water jet propulsion unit at an elevation such that the propulsion unit does not project below the bottom of the boat hull. This can be accomplished, for example, by installing a duct in the stern of the boat, the duct being arranged to connect one or more inlet holes formed in the bottom of the hull with an outlet hole formed in the transom. The water jet propulsion unit is then installed outside the hull in a position such that the inlet of the water jet propulsion unit is in flow communication with the duct outlet at the transom.

Typically, a jet-propelled watercraft generates forward thrust by impelling water rearward out a discharge end of a water jet propulsion unit. Directional control is provided by turning a steering nozzle pivotably mounted at the discharge end of the water jet propulsion unit. The steering position of the steering nozzle is controlled by the operator by manipulation of a steering wheel (in the case of a boat) or handlebars (in the case of a personal watercraft). The turned steering nozzle deflects discharging water flow to one side, generating a lateral thrust which pushes the stern of the boat or watercraft in the opposite direction. This in turn causes the bow of the boat or watercraft to turn toward the side to which the steering nozzle is aimed.

This type of steering arrangement is effective only when the thrust produced by the water jet propulsion unit is greater than a minimum controllable steering thrust. Releasing the throttle causes the vessel to go straight, even if the steering wheel or handlebars are turned, because little or no water discharged rearward results in little or no steering thrust when that discharged water is diverted by the steering nozzle. Turns cannot be made without applying throttle (i.e., thrust).

Some water jet propulsion applications have added a rudder to the steering nozzle to overcome the foregoing problem. However, at any level other than low thrust, a rudder is not required for steering and is a disadvantage in at least two respects. First, a steering rudder must be submerged in the body of water in which the watercraft is operating in order to effect steering. When the steering rudder is submerged, it can be subject to damage. The increased draft of the submerged rudder limits shallow water operation. Second, the steering rudder also increases drag during high-speed operation. This lowers the top speed of the watercraft.

There is a need for a steering arrangement which would overcome the foregoing disadvantages while still allowing low-thrust (i.e., idle, neutral and reverse) steering control.

SUMMARY OF THE INVENTION

The present invention is directed to a jet-powered watercraft in which the water jet propulsion unit has a retractable rudder mounted on the steering nozzle. The steering nozzle is pivotably mounted to the housing of the water jet propulsion unit, with a generally vertical pivot axis. The rudder is pivotable relative to the steering nozzle about a generally horizontal axis, between a retracted position, where the rudder extends out of the water, and a down position, where the rudder is submerged in the water. Preferably the rudder does not pivot relative to the steering nozzle about a generally vertical axis, but rather is turned in unison with the steering nozzle as the latter is pivoted about the generally vertical pivot axis.

In accordance with the preferred embodiments of the invention, the rudder position is controlled as a function of the power being output by the engine. In particular, means are provided for changing the angular position of the rudder when the revolutions per unit time of the powerhead reach a predetermined threshold, e.g., pivoting the rudder from the down position to the retracted position when the powerhead rpm level exceeds the predetermined threshold. In one embodiment, the revolutions per unit time of the drive shaft are detected. In another embodiment, the control position (which may be arrived at via either translation or rotation) of the operator throttle control device is detected. Pivoting of the rudder may be actuated by a solenoid, a hydraulic cylinder or any other functionally equivalent electrical, mechanical or electromechanical device. Alternatively, the rudder can be coupled to the operator's throttle by means of a mechanical linkage or cable.

When the water jet propulsion unit is operated with less than a minimum controllable steering thrust, the rudder is submerged in the water and the watercraft can be steered using the rudder to generate a steering force when the steering nozzle is turned. When the rudder is down, the operator can control the direction of the watercraft by turning the steering wheel or handlebars even at low or no thrust. When the thrust produced by the water jet propulsion unit is greater than the minimum controllable steering thrust, the rudder is retracted, i.e., pivoted to the up position. In the latter case, the operator still controls the watercraft's direction by turning the steering wheel or handlebars, but the steering force is provided by the water flow discharged from the steering nozzle rather than the rudder.

The present invention has utility in any water jet propulsion unit in which steering thrust is effected by redirecting discharge water flow. The powerhead which drives the water jet propulsion unit can be mounted either inboard or outboard of the boat hull.

DETAILED DESCRIPTION OF THE PREFERRED EMBODIMENTS

The preferred embodiments of the invention will be described with reference to an exemplary boat propulsion system of the type shown in FIG. 1. However, a retractable rudder can be incorporated on any other type of water jet propulsion unit as well.

Figure 1:
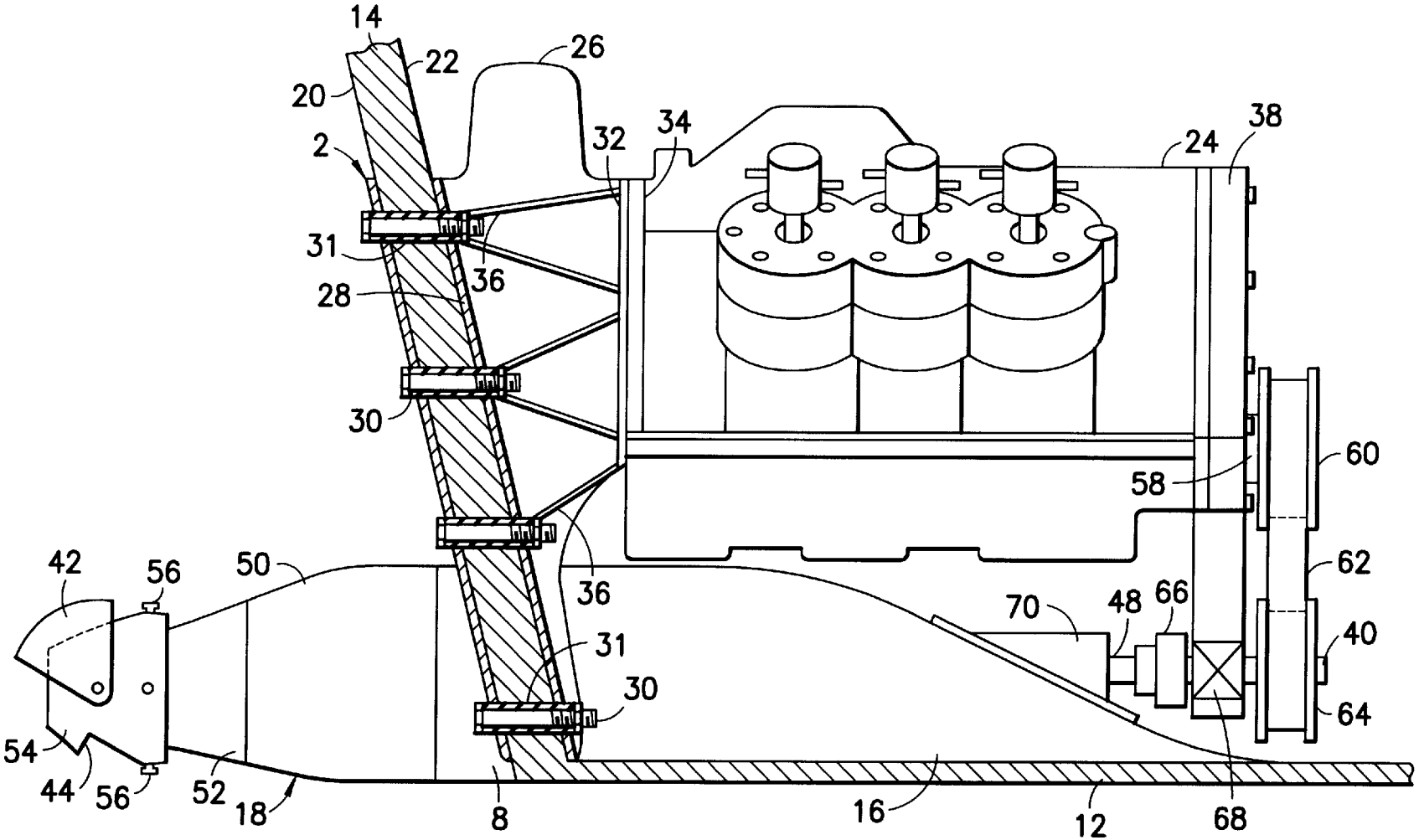
FIG. 1 is a schematic showing an elevational partly sectional view of the stern of an exemplary jet-powered watercraft on which the present invention could be used.

Referring to FIG. 1, there is shown in cross section a molded hull 10 of a marine vessel having a bottom hull portion 12 extending from a transom portion 14 to a forward bow of the boat (not shown). As shown, the hull bottom 12 is attached to the transom 14 in a fluid-tight manner. The hull bottom 12 has a water inlet (not shown) which communicates with a channel or tunnel 16 formed as part of the molded hull. The bottom of a portion of the tunnel can be closed by a bolted-on inlet structure having a built-in grate (not shown). The other end of the tunnel 16 communicates with an inlet opening of a conventional water jet propulsion unit 18, mounted aft of the transom by means of a transom mounting plate 2 attached to an aft face 20 of the transom 14. The transom mounting plate 2 is preferably a sand-cast metal structure having a tube portion 8 (indicated in part by dashed lines in FIG. 1) connected at one end to a lower portion of the plate. The aft end of the tube portion 8 is provided with conventional means (e.g., a flange with threaded holes) for attaching a water jet propulsion unit.

Referring again to FIG. 1, the tube portion 8 effectively becomes an extension of, i.e., is in flow communication with the water duct 16. Preferably the shape of the tube portion 8, at the inlet where it meets the water duct 16, conforms to the shape of the latter, thereby allowing water to flow along a smooth transition from the water duct 16 into the tube portion 8. Similarly, the inlet to the water jet propulsion unit 18 is in flow communication with the outlet of tube portion 8. Thus tube portion 8 of the transom mounting plate 2 guides flowing water from the water duct 16 into the jet propulsion unit.

One conventional type of water jet propulsion unit comprises an impeller (not shown) mounted to an impeller shaft (not shown) and a housing 50 surrounding the impeller. The impeller shaft is connected to a drive shaft 48, which is driven by an engine 24. The impeller of the water jet propulsion unit draws in ambient water via the water inlet (not shown) of the duct 16, the inlet being formed in the hull bottom 12. The water inlet is preferably covered by a grating or screen (not shown) to prevent debris from entering the duct 16, thereby avoiding damage to the impeller inside the water jet propulsion unit 18.

In a typical water jet propulsion unit, the impeller housing 50 is in flow communication with a thrust nozzle 52 having a decreasing cross-sectional area to increase the velocity of the impelled water passing therethrough. A steering nozzle 54 is pivotally mounted to the thrust nozzle by means of a pair of pivot pin assemblies 56. The water flow exiting the steering nozzle 54 can be reversed by activation of a conventional reverse gate 42, which causes water exiting the steering nozzle to reverse and flow through a slot 44 formed in the steering nozzle 54. The steering and shifting controls for controlling the positions of the steering nozzle and the reverse gate comprise well-known structures such as cables, links and levers, not shown in FIG. 1.

As seen in FIG. 1, the water jet propulsion unit is powered by a powerhead or engine 24. The engine 24 may be any suitable power source, such as a gasoline or diesel internal combustion engine. At the forward end of engine 24, there is included a drive plate assembly 35 which is coupled to a crankshaft 58. Drive plate assembly 35 extends below the bottom of the engine 24 as shown and provides a drive output 40 at a point below the engine, namely the forward end of the drive shaft 48, the rear end of which is coupled to the impeller. It will be appreciated that the crankshaft 58 of the engine 24 may be coupled to the drive output 40 by any suitable transmission technique, including a fixed ratio belt drive, such as indicated by pulleys 60 and 64 which are connected by belt 62. The drive shaft 48 is rotatably supported by a bearing 68 incorporated in the drive plate assembly and is isolated from the vibrations produced by the operating engine by means of an isolation coupler 66 which damps and vibrations. In addition, a watertight seal assembly 70 allows leakage-free passage of the drive shaft 48 through the hull of the boat. As a result, when the engine 24 is operating and power is being transmitted to drive shaft 48 from drive output 40 through isolation coupler 66, water will be drawn into the duct or passage 16 and then impelled out the steering nozzle 54 by the impeller of the jet propulsion unit 18.

The engine 24 is cantilevered from the transom 14 by means of a mounting adapter 26, which is attached to the inboard face 22 of the transom by means of a multiplicity of fastener assemblies 30 (e.g., a nut and bolt assembly) which penetrate the transom 14 at different elevations. The mounting adapter 26 is preferably a sand-cast metal structure designed to support the engine in cantilever fashion. Preferably the mounting adapter has a pair of transom mounting flanges 28 (only one of which is visible in FIG. 1) on opposing sides of the adapter. Each transom mounting flange 28 has a plurality of holes which align with corresponding holes formed in the transom mounting plate 2, as well as with corresponding holes formed in the transom 14. Thus, it should be apparent that each fastener 30 passes through a transom mounting flange 28 of the mounting adapter 26, the transom 14, and the transom mounting plate 2. These fastener assemblies fasten the mounting adapter 26 to the inboard face 22 of the transom and fasten the transom mounting plate 2 to the aft face 20 of the transom, sandwiching the transom therebetween.

Preferably the mounting adapter is designed to have a shape to assure that the engine 24 is maintained in a horizontal position. The mounting adapter 26 is cast with a pair of engine mounting flanges 32 (only one of which is visible in the figure). Similarly, the engine 24 is provided with a pair of mounting flanges 34 (again, only one is visible). The aft end of the engine is mounted to the forward face of the mounting adapter by fastening the flanges 34 of the engine to the respective engine mounting flanges 32 using fasteners (not shown). In addition, the mounting adapter 26 is designed with a plurality of external reinforcement ribs 36, which extend from bosses formed on the transom mounting flanges 28. These bosses surround and reinforce the holes in the transom mounting flanges which are penetrated by the fasteners 30. To help prevent vibrations of the engine being transmitted to the boat, rubber mounts 31 are installed in the penetration holes in the transom 14, which rubber mounts are in turn surround the shaft of the bolts passing therethrough.

Figure 2:
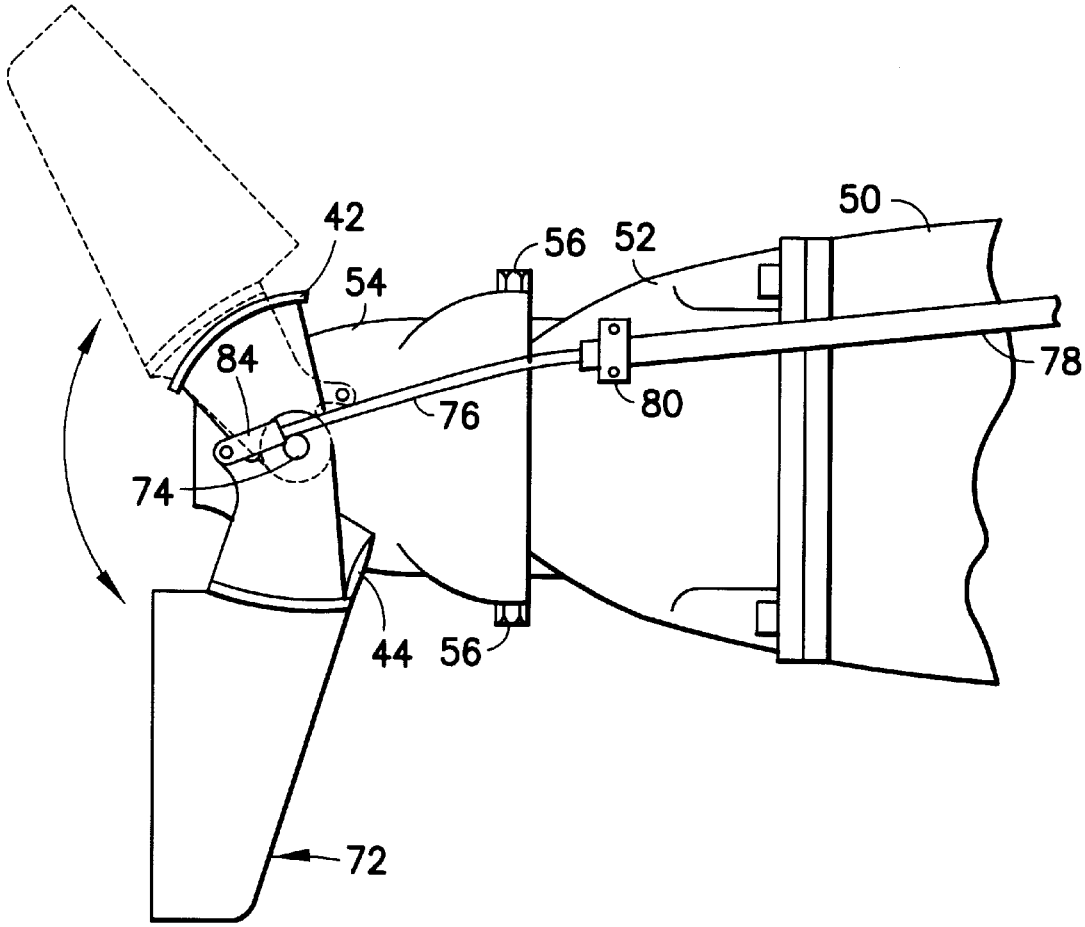
FIG. 2 is a schematic showing an elevational view of part of a water jet propulsion unit having a retractable rudder in accordance with the preferred embodiment of the invention.

Referring to FIG. 2, the preferred embodiments of the invention comprise a retractable rudder 72 pivotably mounted to the steering nozzle 54. The steering nozzle 52 is pivotably mounted to the housing 52 of the water jet propulsion unit, with a generally vertical pivot axis defined by the centerlines of a pair of pivot pin assemblies 56. The rudder is pivotable relative to the steering nozzle about a generally horizontal axis defined by a centerline of a pivot pin 74. The rudder 72 is pivotable about the pivot pin 74 between a down position (indicated by solid lines) and a retracted position (indicated by dashed lines). Preferably the plane of the rudder is generally parallel to the mid-plane of the steering nozzle.

Figure 3:
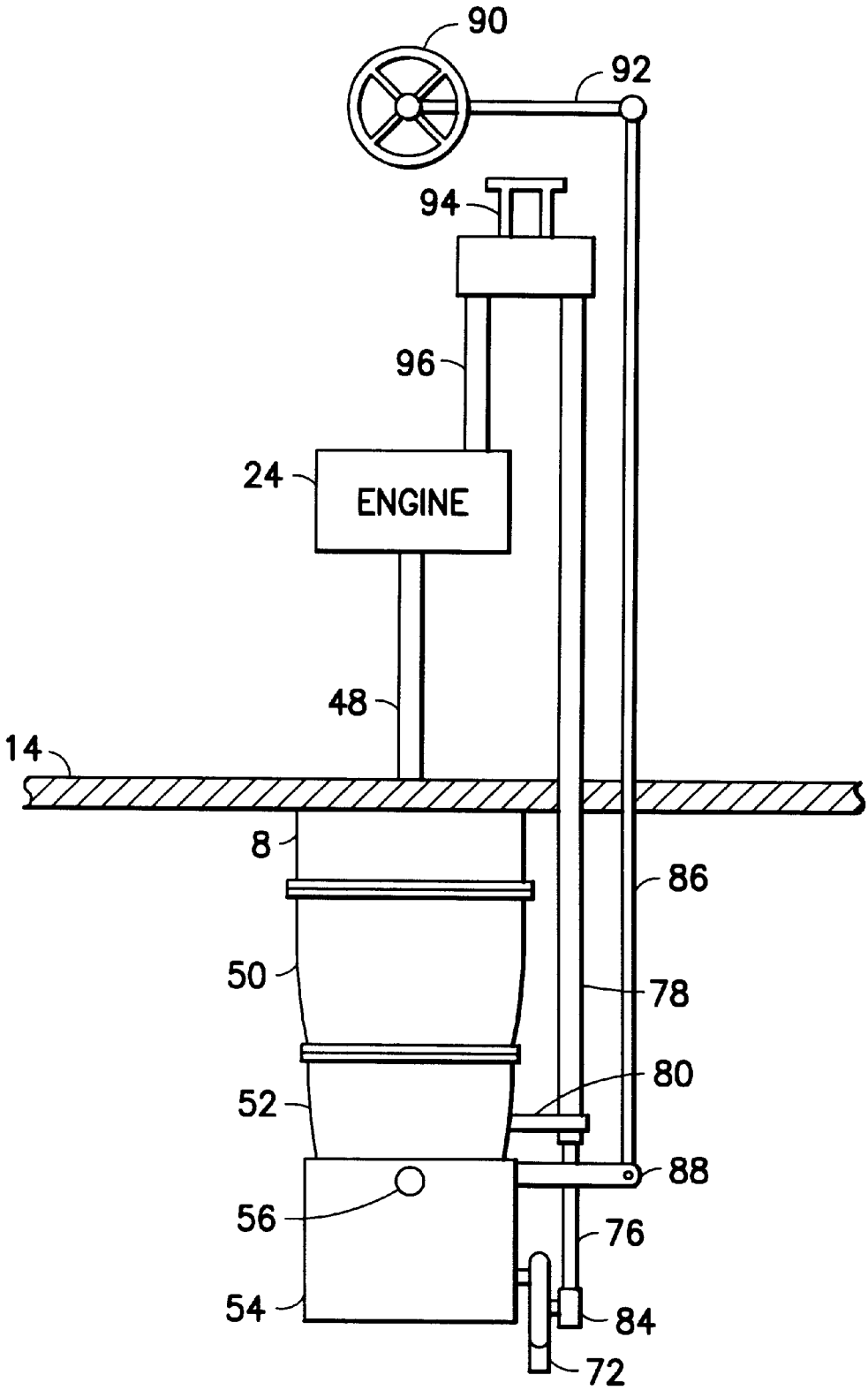
FIG. 3 is a schematic showing a system for actuating a retractable rudder in accordance with one preferred embodiment of the invention.
Figure 4:
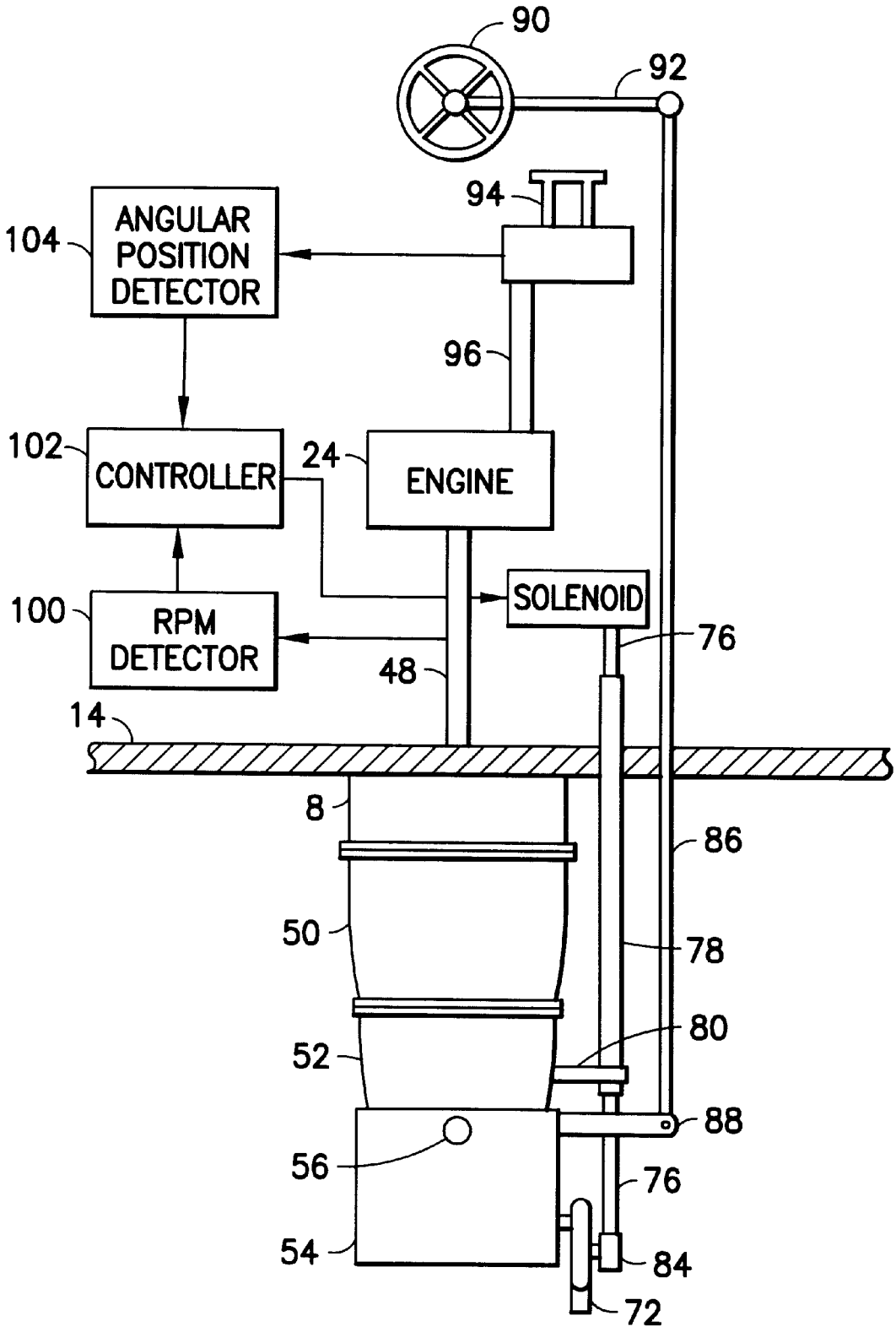
FIG. 4 is a schematic showing a system for actuating a retractable rudder in accordance with other preferred embodiments of the invention.

In accordance with the preferred embodiment shown in FIG. 2, the rudder 74 is pivoted by means of a rudder cable 76 having one end coupled to a pivot pin 82 by means of a coupling 84. The pivot pin 82 in turn is pivotably coupled to the rudder 72. The other end of the rudder cable is connected to an actuator (not shown in FIG. 2). The major portion of the rudder cable is slidably inserted in a rigid tube 78, which penetrates the transom 14 of the boat hull (as seen in FIGS. 3 and 4) via a watertight seal (not shown). The aft end of the tube 78 is mounted to the thrust nozzle 52 by means of a support 80. The path of travel of the center line of the pivot pin 82, during pivoting of the rudder about pivot pin 74, is indicated by the dashed arc in FIG. 2. Since the end of the rudder cable 76 must follow the path traveled by the pivot pin 82, the rudder cable must be able to flex. For that reason, the rigid tube 78 is terminated short of the rudder so that the end portion of the rudder cable is unconstrained by the rigid tube and free to flex as the rudder is pivoted between the retracted and down positions. The person skilled in the art will recognize that the pivot pin 82 must be offset from a line (not shown) connecting the pivot pin 74 and the termination of the tube 78 in order to produce a torque for moving the rudder when the rudder cable is pushed or pulled. During boat operation, the rudder cable 76 can be slid to the right (as seen in FIG. 2) through the tube 72, thereby pulling the rudder 72 from the down position to the retracted position. Thereafter, the rudder cable 76 can be slid to the left through the tube 72 to push the rudder 72 back to the down position.

In accordance with the preferred embodiments of the invention, the rudder position is controlled as a function of the power being output by the engine. In particular, means are provided for changing the angular position of the rudder when the revolutions per unit time of the powerhead increase a predetermined threshold, e.g., pivoting the rudder from the down position to the retracted position when the increasing powerhead rpm level reaches or exceeds the predetermined threshold.

In accordance with one preferred embodiment, the rudder can be coupled to an operator throttle control device by means of a mechanical linkage or cable. The operator control device controls the amount of fuel injected into the engine. FIG. 3 depicts a preferred embodiment in which the rudder cable 76 is coupled to operator throttle control device 94, e.g., the rudder cable 76 is displaced rearward when the operator throttle control device 94 is moved rearward and is displaced forward when the operator throttle control device 94 is moved rearward. As seen in FIG. 3, the rigid tube 78, which guides the rudder cable 76 as it displaces, preferably extends rearward from adjacent the operator throttle control device 94, through the transom 14, to its termination point behind the support 80. The operator throttle control device 94 is also coupled to the engine 24 via a throttle cable 96 for controlling fuel injection. In accordance with the preferred embodiment, the amount of fuel injected is varied in response to movement of the operator throttle control device 94 over its full range of motion, while the rudder is actuated only when the operator throttle control device is moved along a predetermined portion of that range of motion. This can be accomplished, e.g., by providing a first rack mounted to the operator throttle control device, a second rack connected to the rudder cable, a first pinion having teeth engaging the first rack, and a second pinion having teeth engaging the first pinion on one side and the second rack on the other side. In accordance with this arrangement, the rudder cable is moved in the same direction that the operator throttle control device is moved. The length and position of the first rack are selected so that it does not engage the first pinion when movement of the rudder is not desired. Thus, starting from an idle state, the operator throttle control device can be continuously moved forward to increase the engine rpm level, until the point is reached where the first rack engages the first pinion, at which point the rudder begins to pivot from the down position toward the retracted position. The engine rpm level continues to increase as the rudder pivots from the down position to the retracted position. At the point where the rudder reaches the fully retracted position, the first rack disengages from the first pinion. The operator throttle control device can be moved forward further by the boat operator to further increase the engine rpm level with the rudder out of the water. The person skilled in the art will recognize the corresponding sequence of events as the operator throttle control device is returned to the idle position, namely, the rudder is lowered into the water when the engine rpm level corresponding to the minimum controllable steering thrust is reached.

In accordance with other preferred embodiments of the invention, a detector is used to detect the engine rpm level and then the rudder position is controlled as a function of the detected rpm level. As seen in FIG. 4, the rudder position is controlled by a controller 102, which activates a solenoid 98. The solenoid has a coil surrounding a movable iron core coupled to the forward end of the rudder cable 76. In response to positive current supplied by the controller 102, the solenoid coil produces a magnetic field which moves the solenoid core rearward, causing the rudder cable 76 to push the rudder 72 into the down position. Conversely, in response to negative current supplied by the controller 102, the solenoid coil produces a magnetic field which moves the solenoid core forward, causing the rudder cable 76 to pull the rudder 72 into the retracted position. Alternatively, instead of using a solenoid, pivoting of the rudder may be actuated by a hydraulic cylinder or any other functionally equivalent electrical, mechanical or electromechanical device.

In accordance with one preferred embodiment depicted in FIG. 4, the controller 102 activates the solenoid 98 as a function of the output of an rpm detector 100 coupled to the drive shaft 48 (or any other shaft coupled to the drive shaft). In particular, the controller 102 is programmed to activate the solenoid 98 when the rpm detector 100 detects a threshold shaft rpm level corresponding to the minimum controllable steering thrust.

In accordance with another preferred embodiment depicted in FIG. 4, the controller 102 activates the solenoid 98 as a function of the output of an angular (or linear) position detector 104 coupled to the operator throttle control device 94. In particular, the controller 102 is programmed to activate the solenoid 98 when the position detector 104 detects an operator throttle control position corresponding to the minimum controllable steering thrust.

In accordance with the preferred embodiments of the invention, the boat operator controls the angle of the rudder 72 by turning the steering wheel 90. A steering arm 92 has one end connected to the steering column of the steering wheel 90 and the other end pivotably coupled to one end of a steering link 86. [The steering link may comprise any number of components. The simplest case, i.e., a single rod, is depicted in FIG. 4.] The other end of steering link 86 is pivotably coupled to an end of a steering arm 88 rigidly connected to the steering nozzle 54. Thus, the rudder 72 is turned in unison with the steering nozzle 54 by the boat operator.

In accordance with the structures depicted in FIGS. 2–4, when the water jet propulsion unit is operated with less than a minimum controllable steering thrust, the rudder is submerged in the water and the watercraft can be steered using the rudder to generate a steering force when the steering nozzle is turned. When the rudder is down, the operator can control the direction of the watercraft by turning the steering wheel (or handlebars) even at low or no thrust. When the thrust produced by the water jet propulsion unit is greater than the minimum controllable steering thrust, the rudder is retracted, i.e., pivoted to the up position. In the latter case, the operator still controls the watercraft's direction by turning the steering wheel or handlebars, but the steering force is provided by the water flow discharged from the steering nozzle rather than the rudder.

While the invention has been described with reference to preferred embodiments, it will be understood by those skilled in the art that various changes may be made and equivalents may be substituted for elements thereof without departing from the scope of the invention. For example, a rotary solenoid coupled to a bellcrank could be substituted for the linear solenoid. Alternatively, hydraulic cylinders could be used to move the rudder up and down, fluid being selectively supplied to the hydraulic cylinders by pumps controlled by the controller. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "shaft" means any shaft via which an engine transmits power to an impeller of a water jet propulsion unit.

What is claimed is:

1. A jet-powered watercraft comprising:

a powerhead;

a water jet propulsion unit operatively coupled to said powerhead;

a rudder pivotably mounted to said water jet propulsion unit, said rudder being pivotable between a down position and a retracted position;

an element operatively coupled to said powerhead;

a detector arranged to detect a predetermined movement of said element;

an actuator operatively coupled to said rudder; and a controller operatively coupled to said detector and to said actuator, said controller causing activation of said actuator when said predetermined movement is detected, and said actuator causing said rudder to pivot from said down position to said retracted position when said actuator is activated.

2. The watercraft as recited in claim 1, wherein said element comprises a shaft by which said water jet propulsion unit is operatively coupled to said powerhead, and said detector means comprises a revolution rate detector operatively coupled to said shaft, said predetermined movement being rotation of said shaft at a number of revolutions per unit time which equals at least a predetermined threshold, whereby said rudder is moved into said retracted position when said shaft rotates at said predetermined threshold.

3. The watercraft as recited in claim 1, wherein said element comprises an operator throttle control device which controls the revolutions per unit time of said powerhead, and said detector comprises a control position detector operatively coupled to said operator throttle control device, said predetermined movement being movement of said operator throttle control device from a first control position to or past a predetermined second control position, whereby said rudder is moved from said down position to said retracted position when said operator throttle control device is moved to or past said predetermined second control position.

4. The watercraft as recited in claim 1, wherein said water jet propulsion unit comprises:

a housing having an inlet and an outlet; and a steering nozzle pivotably mounted to said housing with a generally vertical pivot axis and receiving water flow exiting said housing outlet, wherein said rudder is pivotably mounted to said steering nozzle with a generally horizontal pivot axis.

5. The watercraft as recited in claim 4, wherein said controller is an electronic controller, and said actuator comprises a solenoid.

6. The watercraft as recited in claim 4, further comprising a link operatively coupled to said actuator, said link comprising a portion pivotably mounted to said rudder at a distance from said generally horizontal pivot axis of said rudder.

7. The watercraft as recited in claim 6, further comprising a pivot which pivotably couples said link to said rudder, said pivot traversing an arc above said generally horizontal pivot axis of said rudder as said rudder pivots between said down position and said retracted position.

8. The watercraft as recited in claim 1, wherein said rudder extends out of the water in said retracted position and is submerged in the water in said down position.

9. A watercraft comprising:

a powerhead;

a water jet propulsion unit driven by said powerhead;

a rudder pivotably mounted to said water jet propulsion unit, said rudder being pivotable between a down position and a retracted position; and means for changing the position of said rudder when the revolutions per unit time of said powerhead reaches a predetermined threshold.

10. The watercraft as recited in claim 9, wherein said means comprise:

a shaft operatively coupled to said powerhead; and a detector arranged to detect when revolutions per unit time of said shaft reaches said predetermined threshold.

11. The watercraft as recited in claim 9, wherein said means comprise:

a solenoid operatively coupled to said rudder; and an electronic controller programmed to activate said solenoid when said predetermined threshold is reached.

12. The watercraft as recited in claim 10, wherein said means further comprise:

a solenoid operatively coupled to said rudder; and an electronic controller programmed to activate said solenoid in response to a signal from said detector indicating detection of said predetermined threshold.

13. The watercraft as recited in claim 9, wherein said means comprise:

an operator throttle control device which controls the revolutions per unit time of said powerhead; and a control position detector operatively coupled to said operator throttle control device for detecting a predetermined control position of said operator throttle control device corresponding to a predetermined number of revolutions per unit time of said powerhead.

14. The watercraft as recited in claim 13, wherein said means further comprise:

a solenoid operatively coupled to said rudder; and an electronic controller programmed to activate said solenoid when said predetermined control position is reached.

15. The watercraft as recited in claim 9, wherein said means comprise:

an operator throttle control device having a range of motion;

a throttle cable for coupling said powerhead to said operator throttle control device, the movement of said operator throttle control device over said range of motion determining the revolutions per unit time of said powerhead; and a rudder cable for coupling said operator throttle control device to said rudder such that said rudder is pivoted when said operator throttle control device travels along a predetermined portion of said range of motion.

16. The watercraft as recited in claim 9, wherein said water jet propulsion unit comprises:

a housing having an inlet and an outlet; and a steering nozzle pivotably mounted to said housing with a generally vertical pivot axis and receiving water flow exiting said housing outlet, wherein said rudder is pivotably mounted to said steering nozzle with a generally horizontal pivot axis.

17. The watercraft as recited in claim 15, further comprising a stern wall and a tube penetrating said stern wall, said rudder cable being slidable in said tube.

18. A water jet propulsion unit comprising:

a housing having an inlet and an outlet; and a steering nozzle pivotably mounted to said housing with a generally vertical pivot axis and receiving water flow exiting said housing outlet;

a rudder pivotably mounted to said steering nozzle with a generally horizontal pivot axis, said rudder being pivotable between a down position and a retracted position;

an actuator link comprising a portion pivotably mounted to said rudder at a distance from said generally horizontal pivot axis of said rudder; and a pivot which pivotably couples said actuator link portion to said rudder, said pivot traversing an arc above said generally horizontal pivot axis of said rudder as said rudder pivots between said down position and said retracted position.

19. A jet-powered watercraft comprising:

a powerhead;

a water jet propulsion unit driven by said powerhead;

a rudder pivotably mounted to said water jet propulsion unit, said rudder being pivotable between a down position and a retracted position;

an operator throttle control device which controls the revolutions per unit time of said powerhead over a range of motion; and a cable for coupling said operator throttle control device to said rudder such that said rudder is pivoted when said operator throttle control device travels along a predetermined portion of said range of motion.

20. A jet-powered watercraft comprising:

a powerhead;

a water jet propulsion unit operatively coupled to said powerhead;

an operator throttle control device having a range of control positions for controlling the revolutions per unit time of said powerhead;

a rudder pivotably mounted to said water jet propulsion unit, said rudder being pivotable between a down position and a retracted position;

a rudder actuation system for maintaining said rudder in said down position when said operator throttle control device has a control position in a first subrange of said range of control positions and in said retracted position when said operator throttle control device has a control position in a second subrange of said range of control positions, said first and second subranges not overlapping.

21. The watercraft as recited in claim 20, wherein said rudder actuation system comprises a switch which changes state when the control position of said operator throttle control device reaches a predetermined control position between said first and second subranges of control positions.

22. The watercraft as recited in claim 21, wherein said rudder actuation system further comprises an actuator operatively coupled to said switch and to said rudder, whereby said actuator causes said rudder to move from said down position to said retracted position in response to a change in the control position of said operator throttle control device from said first subrange to said second subrange.

23. The watercraft as recited in claim 22, wherein said actuator comprises a solenoid.

24. The watercraft as recited in claim 20, wherein said rudder actuation system comprises:

a control position detector operatively coupled to said operator throttle control device for outputting a feedback signal in response to a change in said operator throttle control device control position from said first subrange to said second subrange; and a controller which outputs a control signal in response to receipt of said feedback signal.

25. The watercraft as recited in claim 24, wherein said rudder actuation system further comprises an actuator operatively coupled to said controller and to said rudder, whereby said actuator causes said rudder to move from said down position to said retracted position in response to said control signal from said controller.

26. The watercraft as recited in claim 25, wherein said actuator comprises a solenoid.

* * * * *